United States Patent [19]

Rérolle

[11] Patent Number: 4,523,724

[45] Date of Patent: Jun. 18, 1985

[54] SEMI-AUTOMATIC FIXED POSITION MACHINE FOR COILING DOWN A CABLE

[75] Inventor: Yves Rérolle, Lyons, France

[73] Assignee: Societe Anonyme dite-les Cables de Lyon, Cedex, France

[21] Appl. No.: 589,370

[22] Filed: Mar. 14, 1984

[30] Foreign Application Priority Data

Mar. 15, 1983 [FR] France ..... 83 04230

[51] Int. Cl.[3] ..... B65H 54/00; B21C 47/02; B21C 47/00

[52] U.S. Cl. ..... 242/54 R; 242/82; 254/134.3 R

[58] Field of Search ..... 242/54 R, 83, 82, 85, 242/85.1; 254/134.3 R, 134.35 C, 382, 400

[56] References Cited

U.S. PATENT DOCUMENTS

| | | | |
|---|---|---|---|
| 2,227,442 | 1/1941 | De Millar | 242/83 X |
| 3,719,348 | 3/1973 | Wells | 254/134.35 C |
| 4,145,014 | 3/1979 | Chatard et al. | 242/83 |
| 4,296,917 | 10/1981 | Day et al. | 254/400 |

FOREIGN PATENT DOCUMENTS

| | | | |
|---|---|---|---|
| 1272531 | 7/1960 | France . | |
| 88593 | 9/1965 | France . | |
| 325337 | 3/1972 | U.S.S.R. | 242/83 |
| 329930 | 4/1972 | U.S.S.R. | 242/83 |

*Primary Examiner*—Stuart S. Levy
*Assistant Examiner*—L. Doigan
*Attorney, Agent, or Firm*—Sughrue, Mion, Zinn, Macpeak & Seas

[57] ABSTRACT

A coiling-down tank (1) comprises a circular outer wall (3) delimiting a coiling-down zone, and cable (4) to be coiled down (e.g. heavy electric cable) is delivered to the machine (10) from a point (80) vertically above the center of the tank. The machine comprises an upper support bracket (70) mounted to rotate about the vertical axis of the tank, a sloping coiling-down arm (20) connected at its upper end to said bracket and supported at its lower end by running means disposed to run along the said wall (3) of the tank (1). The arm is fitted with a carriage (30) that is longitudinally displaceable along the arm, and an inlet chute (60) receives cable from the point (80). The inlet chute guides the cable into the carriage, and the lower end of the carriage serves to dispense the cable into the tank for coiling down. In operation, the cable passes successively from the inlet chute, into a variable point along the carriage depending on its longitudinal position along the arm, and then from the lower end of the carriage into the tank.

7 Claims, 8 Drawing Figures

SEMI-AUTOMATIC FIXED POSITION MACHINE FOR COILING DOWN A CABLE

The present invention relates to a semi-automatic fixed position machine for coiling down a cable inside a tank, the cable being distributed from vertically above the center of the tank which includes an outside wall delimiting a coiling down zone.

BACKGROUND OF THE INVENTION

Electrical cables which are manufactured and delivered in very long single-piece lengths cannot be wound on drums since they would be of excessive size. They are thus stored in storage tanks by means of an operation known as coiling down.

While it is being coiled down, a cable receives a twist of one turn about its longitudinal axis per turn of the coil.

This twist is borne more or less well by the internal structure of the cable which means that efforts are made both to reduce the twisting and to ensure that it is evenly distributed. To reduce the twisting, the average diameter of the coil turns is increased. To distribute the twist more evenly, the starting point of the twist is raised in height, this starting point is generally a pulley or a spout with or without a guiding funnel, delivering cable on the vertical axis of the tank.

Winding down is traditionally done by human hand, however with heavy cables that may exceed 70 kg/m (kilograms per meter) completely manual coiling down is not possible.

French patent specification number 1 433 701 and its 1st certificate of addition number 88 593 describe a mechanical device for giving assistance in coiling down a cable, the device uses a plurality of pulleys at adjustable spacing which are mounted on a rotating support turning about a the vertical axis of the tank.

This device suffers from drawbacks such as the danger of a heavy cable sagging excessively or even collapsing under its own weight between two successive support points when only a small number of pulleys are used, or such as the need to use the coiling down device during uncoiling as well because of the permanent presence of the said structure on the ground in the center of the tank which impedes natural uncoiling of the cable.

Preferred embodiments of the present invention remedy these drawbacks by providing a semi-automatic machine which conveys a cable via many support points on a deformable structure which enables the cable to be laid in spiral turns of diameter varying in a ratio of up to 1 to 3, and also enabling a cable inlet chute to be moved out of the way to free the cable near the funnel hole, and thus allow the cable to be uncoiled naturally.

SUMMARY OF THE INVENTION

The present invention provides a semiautomatic fixed position machine for coiling-down a cable inside a tank, the tank comprising a circular outer wall delimiting a coiling-down zone, and the cable to be coiled down being delivered to the machine from a point vertically above the center of the tank, the improvement wherein the machine comprises an upper support bracket mounted to rotate about the vertical axis of the tank, a sloping coiling-down arm connected at its upper end to said bracket and supported at its lower end by running means disposed to run along the said wall of the tank, said arm being fitted with a carriage that is longitudinally displaceable along the arm, and said machine including an inlet chute for receiving cable to be coiled down and for guiding said cable into said longitudinally displaceable carriage, the lower end of said carriage serving to dispense cable into the tank for coiling down, with cable passing, in operation, from said inlet chute, into a variable point along said carriage depending on its longitudinal position along said arm, and then from the lower end of said carriage into said tank.

Advantageously said inlet chute is retractable to a position where it does not interfere with cable uncoiling operations.

Preferably rectangular sets of guide rollers constituting a cable-guiding cage are provided along the cable path through said machine.

BRIEF DESCRIPTION OF THE DRAWINGS

An embodiment of the invention is described by way of example with reference to the accompanying drawings in which.

MORE DETAILED DESCRIPTION

Figure 1:
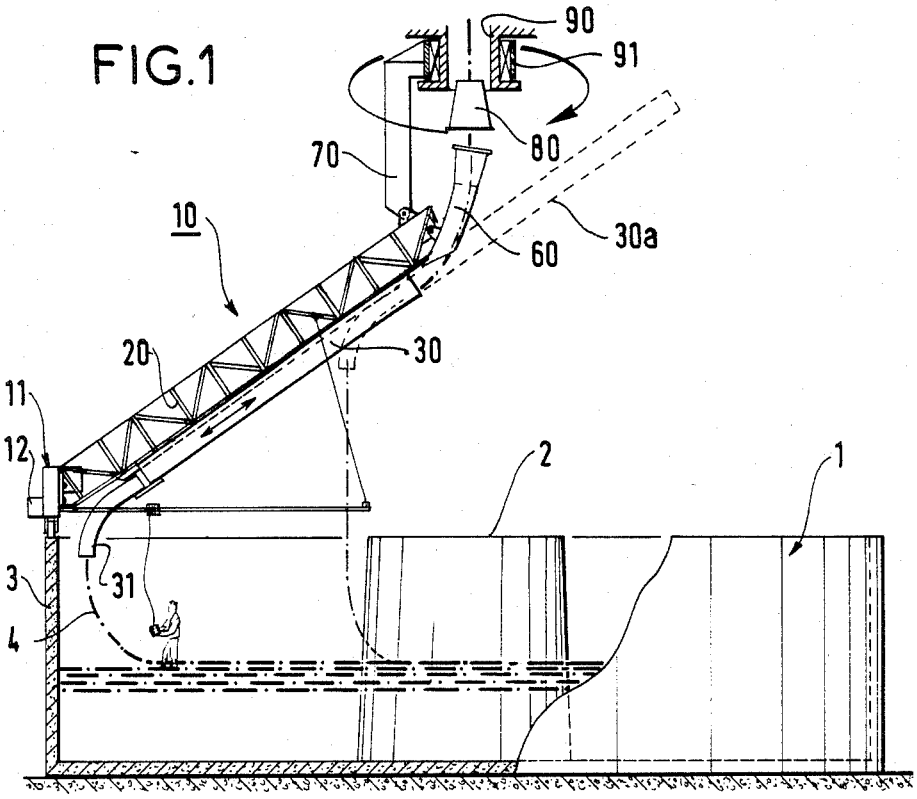
FIG. 1 is a partially cut-away diagrammatic side view of a coiling-down machine in accordance with the invention during a coiling-down operation.

FIG. 1 shows a circular tank 1 having a slightly tapering central portion 2 for facilitating cable uncoiling, and an outside wall 3 which is cylindrical. Drive means 11 for a coiling-down arm 20 of a coiling-down machine 10 runs along the top of the wall 3. The drive means 11 has a motor 12. The arm 20 has its top end connected to a bracket 70 which is rotatable about hub 90 fitted with a bearing 91 whose axis of rotation is aligned with the axis of the tank. The coiling arm has a carriage 30 and a cable-guiding inlet chute 60.

A cable 4 is fed down through the hub 90, through a flared guide funnel 80, through the inlet chute 60 which is retractable when not in use, along the carriage 30 and then leaves the carriage via a dispensing chute 31 before finally dropping vertically into the tank to form coils. The carriage 30 is movable back and forth along the arm 20 and serves to dispense the cable from a point vertically above the current spiral turn. The position of the carriage drawn in full lines in FIG. 1 corresponds to a turn of maximum diameter, while the position 30*a* shown in dashed lines corresponds to a turn of minimum diameter.

Figure 2:
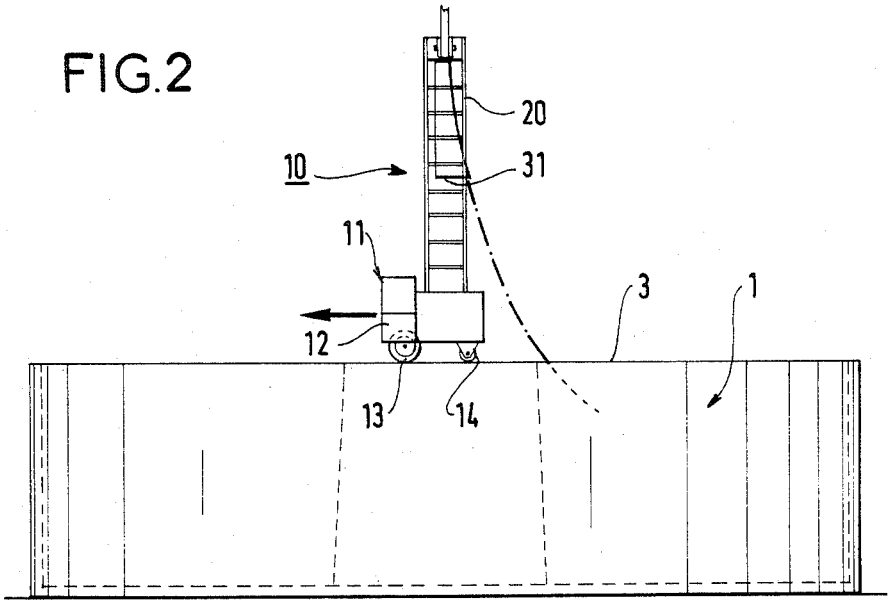
FIG. 2 is an end view of the machine shown in FIG. 1 showing how the arm is driven round the tank.

In FIG. 2 shows the outside wall 3 of the tank 1 with the drive means 11 of the arm 20 running along the top of the wall. The drive means 11 include the motor 12 which turns a drive wheel 13. The drive means also inclues an idler wheel 14 for reasons of stability. FIG. 2 also shows that the dispensing chute 31 allows the cable to trail along a natural curve (running to the right in FIG. 2) while it is being coiled down.

Figure 3:
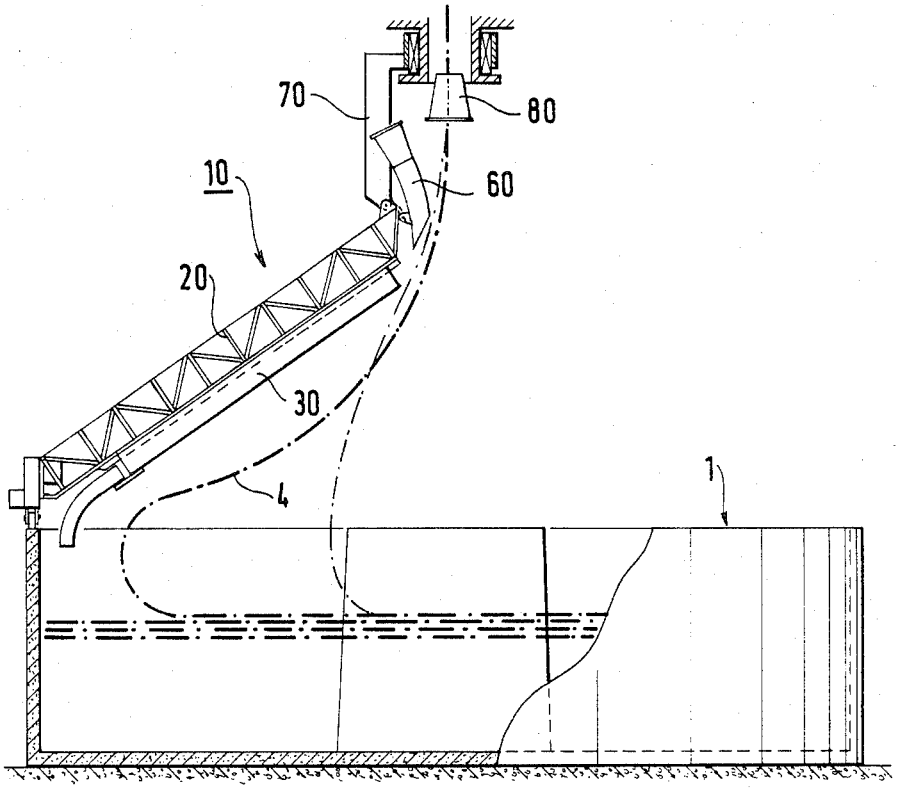
FIG. 3 is a view similar to FIG. 1 showing the machine during an uncoiling operation.

FIG. 3 shows the position of the coiling-down machine during an uncoiling operation. The cable inlet chute 60 to the machine 10 is tilted back against the bracket 70 and the carriage 30 is in its maximum diameter position to leave clear access to the funnel 80 for the cable 4. The coiling down machine 10 thus does not hinder uncoiling which can be performed simply by drawing up the cable 4 through the hub by means not shown.

Figure 4:
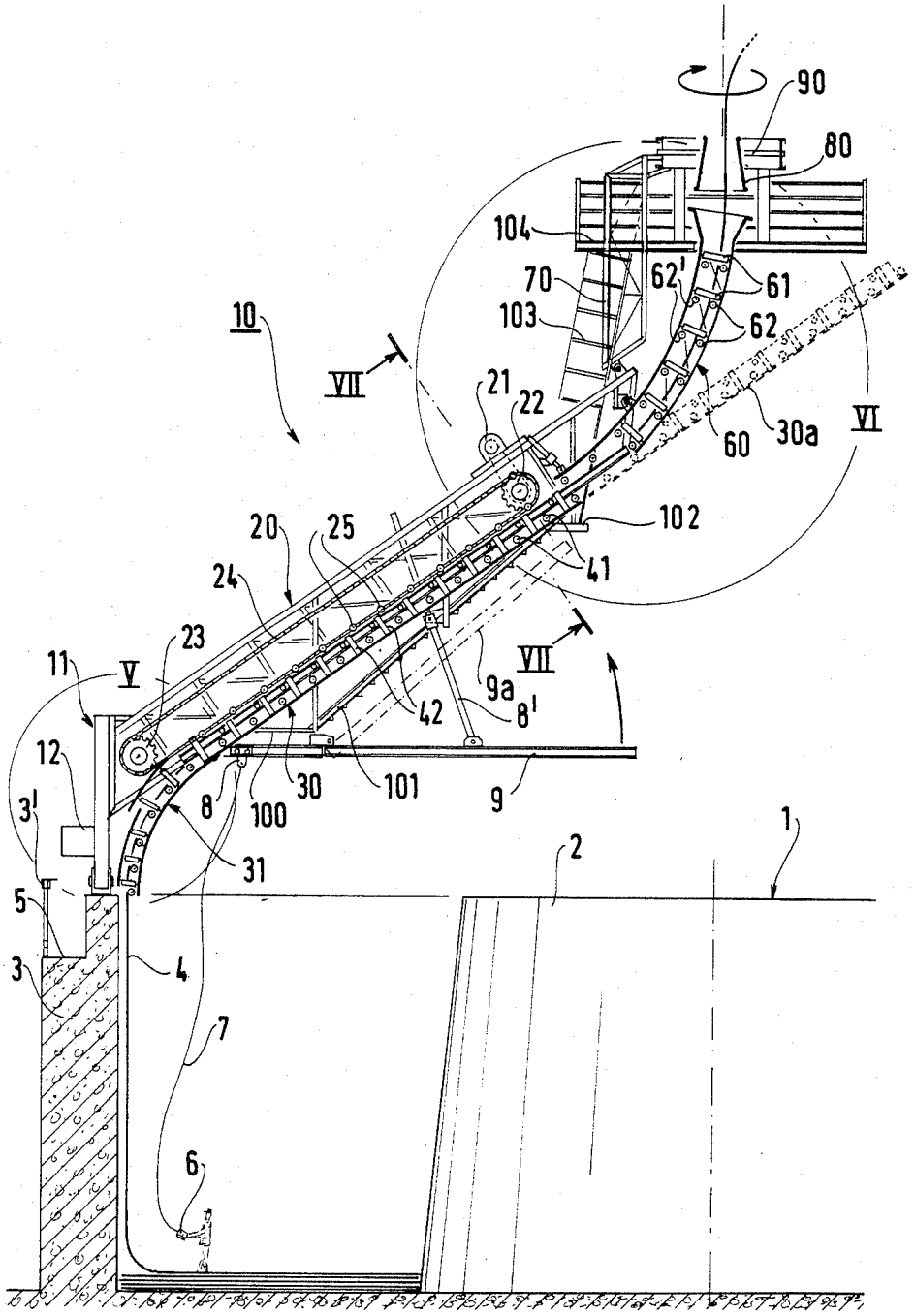
FIG. 4 is a partially cut-away side view of the machine during a coiling-down operation and drawn to a larger scale than FIG. 1.

FIG. 4 shows the coiling down machine 10 and parts of the tank 1 in greater detail. The outside wall 3 has a gangway 5 running round the outside of its top edge to enable an operator to monitor the machine. A rail 3' is provided for safety. For closer monitoring or for taking direct action on the machine, there are platforms 100, 102 and 104 to which an operator may gain access via ladders 101 and 103 installed on the arm 20 and on the bracket 70. The platforms and the ladders thus move round with the machine. The carriage 30 is driven by two chains 24 (and 24' see FIG. 7) which extend over two pairs of toothed wheels 23, 23' and 22, 22', with the wheels 22, 22' being drive wheels driven by a motor 21. To avoid excessive repetition of "see FIG. N", it is pointed out the reference numerals with a prime generally designate items which are symmetrical to the items designated by the same numeral without a prime, and that if not visible in FIG. 4, the reference numeral with a prime is generally to be found in one of the following more detailed figures. Over a portion of their length, the chains 24, 24' are interconnected by rollers 25. The carriage 30 has cable-guiding rollers, including both horizontal rollers 41, and pairs of side rollers 42 at 90° thereto. By suitable action of the drive motor 21 on the chains 24, 24', the carriage 30 can be moved between the extreme position shown in full lines to the opposite extreme position 30*a* shown in dashed lines.

At its dispensing end, the carriage 30 has a dispensing chute 31 which is curved in such a manner as to enable the cable 4 to be brought to a point close to the inside top edge of the wall 3.

The inlet chute leading 60 to the carriage 30 includes horizontal rollers 62, 62' arranged in pairs with associated pairs of perpendicularly oriented rollers 61, 61' so as to constitute a series of closed roller cages for guiding the cable. These cages are disposed along the inlet chute from end to end.

The operator is provided with a control box 6 suspended from a cable 7 which is fixed to a small hoist 8 mounted to run along a rail 9 which extends radially relative to the tank. The rail 9 may be lifted to a position 9*a* by an actuator 8' to move it out of the way of an uncoiling operation.

Figure 5:
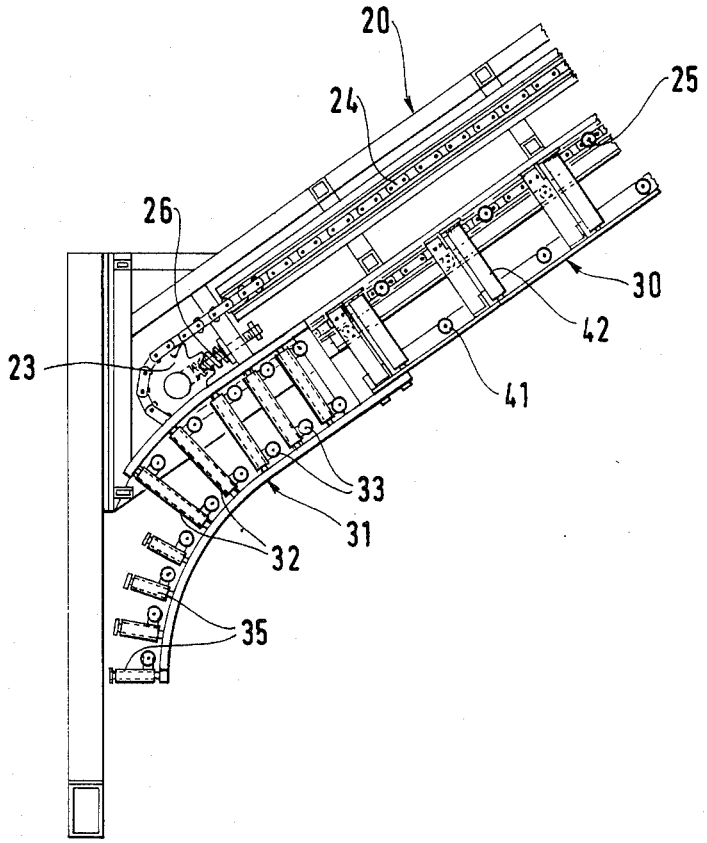
FIG. 5 is a detail V of FIG. 4 to a larger scale.

FIG. 5 shows the bottom end of the coiling arm 20. The carriage 30 is moved longitudinally up and down the arm by means of the two chains 24, 24' rotating about the toothed end pulley wheels 23, 23'. These pulley wheels are spring 26 mounted so as to keep the chains permanently taut. The carriage 30 has the curved dispensing chute 31 fitted to its bottom end. The chute 31 has a series of horizontal rollers 33, and at its upper end these are flanked by pairs of long perpendicular rollers 32 which have mountings at both ends. Further along the chute 31, the flanking pairs of long rollers are replaced by flanking pairs of short rollers 35 which have mountings only at their ends adjacent to the horizontal rollers 33. These rollers are located so as to impose a suitable trailing curve on the cable 4, as best seen in FIG. 2.

Figure 6:
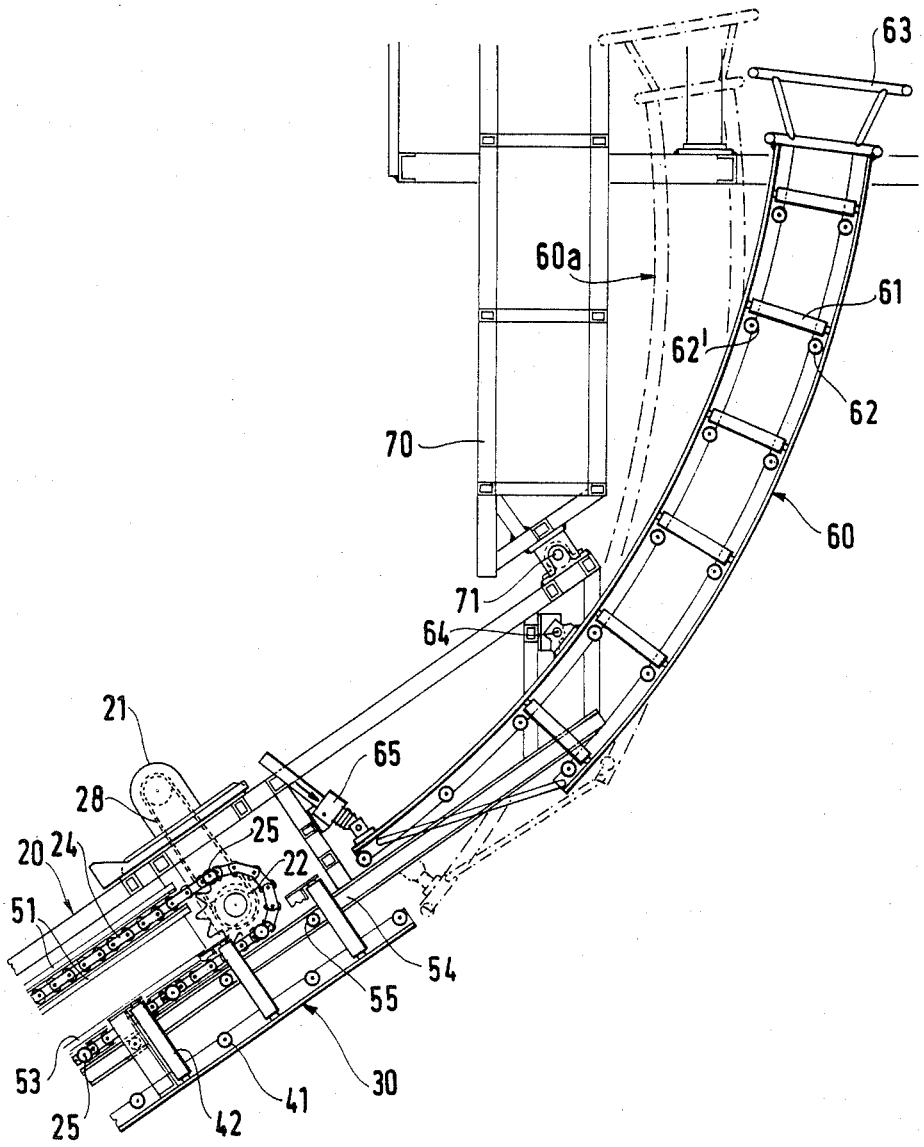
FIG. 6 is a detail VI of FIG. 4 to a larger scale.

FIG. 6 shows the top end of the coiling arm 20, and in particular the inlet chute 60 with its rectangular cages of guide rollers 61, 61', 62, 62', and an inlet ring 63. The chute 60 is pivoted about an axis 64 under the control of an actuator 65. Its retracted position 60*a* is shown in dashed lines.

The bracket 70 is connected to the coiling arm 20 by a hinge 71 which compensates for small differences which may exist between the circular path defined for the bracket 70 by the hub 90 and the circular path defined for the arm 20 by the wall 3.

The carriage 30 runs on rails 54 and 54' which it engages by means of small wheels 55, 55'. The cable is thus emprisoned between the rollers 25 mounted between the chains 24 and 24' and the rollers 41, 42 and 42' mounted on the carriage itself. Thus, over the major part of the length of the carriage, the cable is guided inside a generally rectangular cage of rollers.

Figure 7:
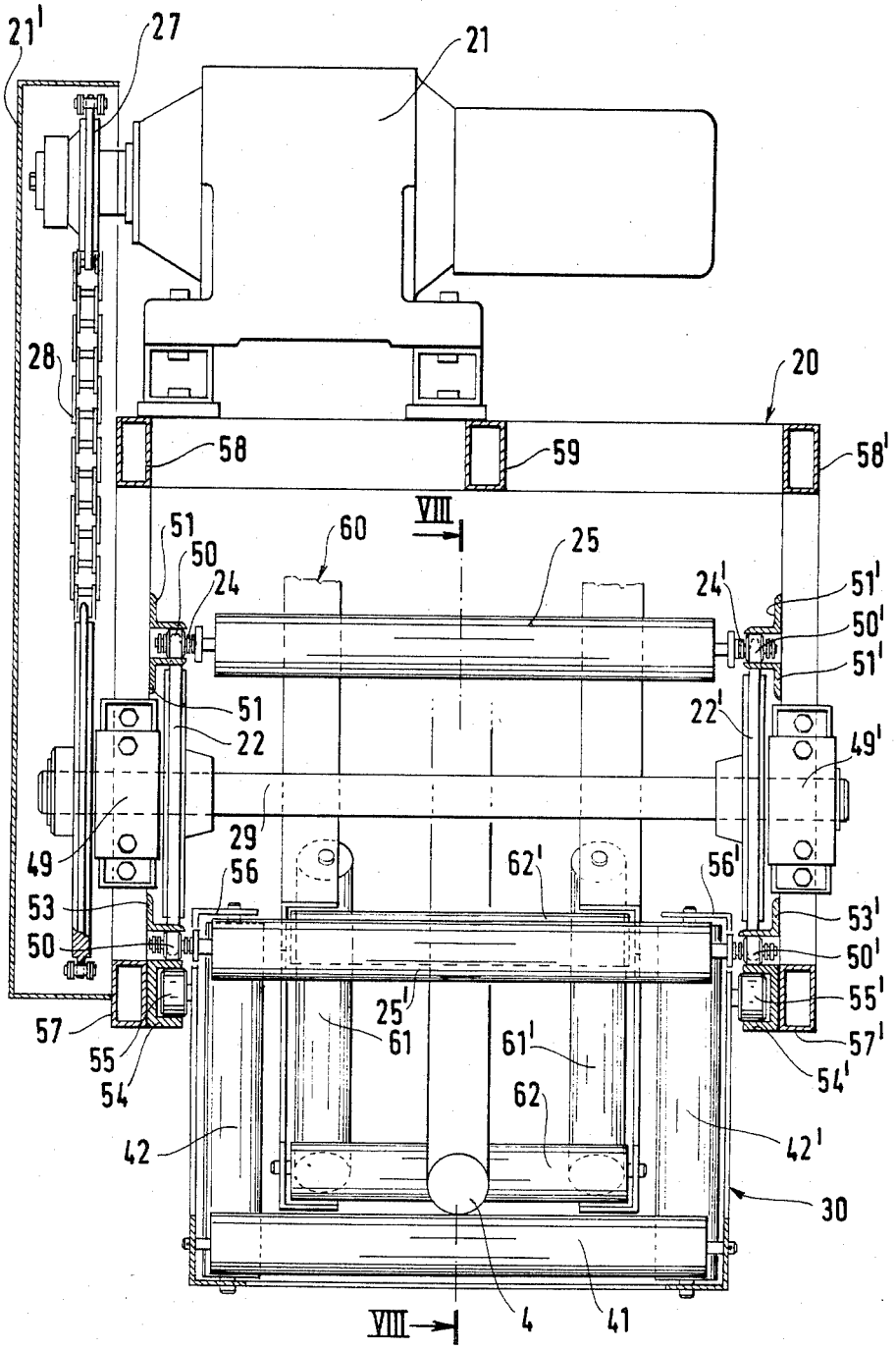
FIG. 7 is a section on a line VII of FIG. 4 to a larger scale to show carriage drive means.

FIG. 7 shows the relative dispositions of the carriage guide and drive means in greater detail.

The drive motor 21 has an outlet shaft 27 which drives a shaft 29 by means of a chain 28. The shaft 29 carries the toothed wheels 22, 22' which drive the chains 24, 24'. A protective covering 21' hides the chain 28.

The coiling arm 20 is made up from box-section girders 57, 57', 58, 58', and 59.

The shaft 29 is mounted on bearings 49, 49' which are fixed to the girders of the coiling arm 20.

Figure 8:
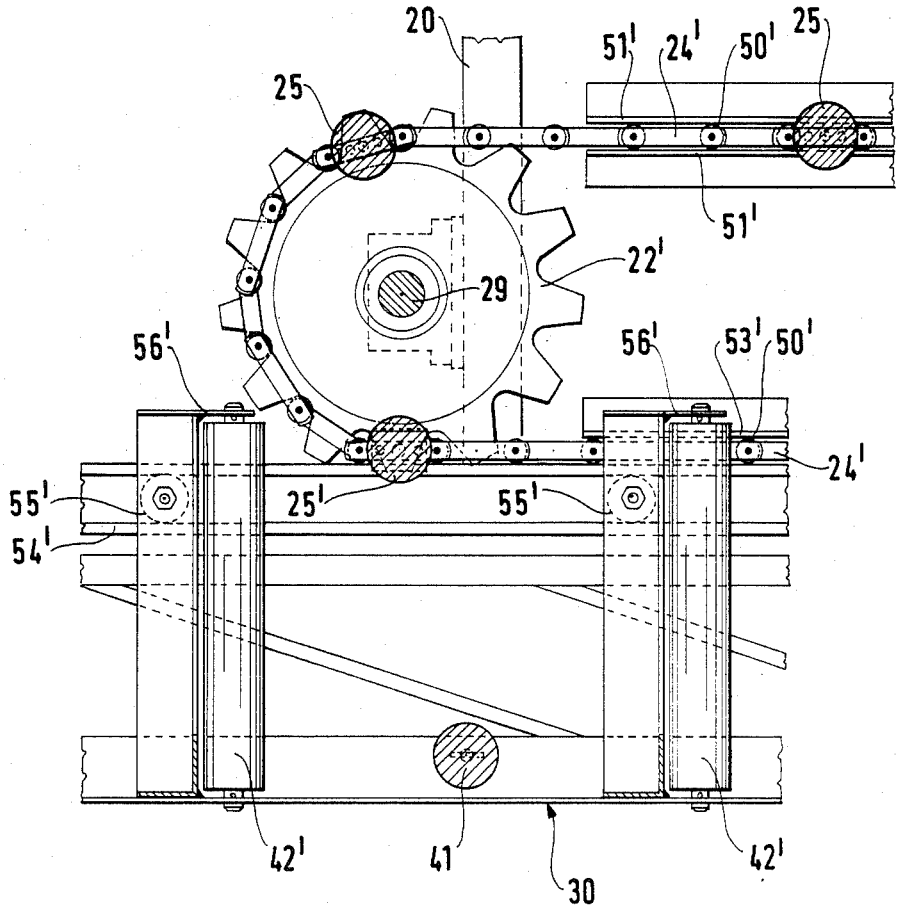
FIG. 8 is a section on a line VIII in FIG. 7.

The toothed wheels 22, 22' drive respective chains 24, 24' which are best seen in FIG. 8 by looking at their roller-supporting links 50, 50'. The chains are guided along upper channels 51, 51' and along lower channels 53, 53', where one side of each of the lower channels is constituted by the guide rails 54, 54' for guiding the carriage 30. The carriage's guide wheels 55, 55' which engage the guide rails 5', 54' can be seen clearly in this figure.

The chains drive the chain rollers 25, 25', and the lower chain rollers 25' constitutes the top part of the rectangular cage through which the cable 4 is guided as its passes along the carriage 30. The three other sides of the cage are constituted by the horizontal rollers 41 and the side rollers 42, 42' of the carriage itself. These rollers are mounted on stub angle girders 56, 56'.

The position of the inlet chute 60 can also be seen in this figure. Its horizontal rollers 62, 62' are short enough to fit between the side rollers of the carriage, so as to enable the carriage to move past the bottom end of the guide chute while continuously guiding cable into the carriage.

The bottom end of the chute 60 is just beyond the top end of the chains 24, 24', so the chain rollers 25 do not come into conflict with the chute.

FIG. 8 is a side view of the carriage in the immediate vicinity of the chain drive shaft 29. It shows the horizontal rollers 41, and the perpendicular side rollers 42' mounted on the stub angle girders 56'. The rail-engaging guide wheels 55' are shown in dashed lines, running in the channel section rail 54'.

The toothed wheel 22' is driven by the shaft 29, and in turn drives the chain 24'. It is supported in a bearing 49'. The chain 24' has links 50' running along channels defined between two upper angle girders 51' and between a lower angle girder 53' and the guide rail 54'. The chain supports one end of rollers 25 and 25' and the rollers marked 25' constitute the fourth or top side of the rectangular cage through which the cable 4 is guided.

Coiling down is performed as follows:

The cable leaves the funnel 80 and passes into the inlet chute 60, and thence passes into the carriage 30. It leaves the bottom end of the carriage via the dispensing chute 31. The dispensing chute 31 is curved downwardly in a radial vertical plane (see FIG. 1) and also backwardly in a vertical plane at right angles thereto (see FIG. 2), thus allowing the cable to drop along a natural curve into the tank. An operator inside the tank forms the coils manually. The carriage is movable under manual control, with the operator using the control box 6 for this purpose. Cable uncoiling simply requires the coiling-down machine to be folded out of the way as shown in FIG. 3, with the cable being drawn directly into the funnel 80 by means not shown.

I claim:

1. A semi-automatic fixed position machine for coiling-down a cable inside a tank, the tank comprising a circular outer wall delimiting internally, a coiling-down zone, and wherein the cable to be coiled down being delivered to the machine from a point vertically above the center of the tank, the improvement wherein a hollow hub is fixedly mounted above the tank at its center through which said cable passes vertically downwardly, and the machine comprises an upper support bracket mounted for rotation on said hub about the vertical axis of the tank, a sloping coiling-down arm, means connecting said arm at its upper end, to said bracket, and running means fixed to said arm, at is lower end, for supporting said arm lower end on the top of said outer wall of the tank with said running means running along said outer wall, a carriage fitted to said arm for longitudinal displacement along the arm, and said machine including an inlet chute mounted to said bracket for receiving cable to be coiled down and for guiding the cable into said longitudinally displaceable carriage, the lower end of said carriage serving to dispense the cable into the tank, for coiling-down, with the cable passing, in operation from the inlet chute into a variable point along said carriage depending upon its longitudinal position along said arm, and then from the lower end of said carriage into said tank.

2. A machine according to claim 1, further comprising means for retracting said inlet chute on said bracket to a position out of alignment with said hollow hub where said inlet chute does not interfere with cable uncoiling operations.

3. A machine according to claim 2, further comprising a cable-dispensing chute fitted to said carriage at said lower end thereof.

4. A machine according to claim 1, wherein rectangular sets of guide rollers constituting a cable-guiding cage are provided along the cable path through said machine.

5. A machine according to claim 4, wherein said cable guiding cage of rectangular sets of rollers extends over the entire length of said inlet chute.

6. A machine according to claim 4, wherein said cable guiding cage of rectangular sets of rollers extends over the major part of the length of the carriage.

7. A machine according to claim 1, further comprising a cable-dispensing chute filled to said carriage at said lower end thereof.

* * * * *